US007416367B2

(12) United States Patent
St. Onge et al.

(10) Patent No.: US 7,416,367 B2
(45) Date of Patent: Aug. 26, 2008

(54) LATERAL FORCE RESISTANCE DEVICE

(76) Inventors: Gene St. Onge, 6839 Saroni Dr., Oakland, CA (US) 94611; Dan Rhoades, 37685 Glenmore Dr., Fremont, CA (US) 94536; James Winslow, 211 Falcon Pl., Clayton, CA (US) 94517

( * ) Notice: Subject to any disclaimer, the term of this patent is extended or adjusted under 35 U.S.C. 154(b) by 0 days.

(21) Appl. No.: 11/417,674

(22) Filed: May 4, 2006

(65) Prior Publication Data

US 2007/0000187 A1 Jan. 4, 2007

Related U.S. Application Data

(60) Provisional application No. 60/680,768, filed on May 13, 2005.

(51) Int. Cl.
*E02D 5/74* (2006.01)

(52) U.S. Cl. ..... 405/230; 405/229; 405/249; 52/155; 52/157

(58) Field of Classification Search ..... 405/229–232; 52/155–157, 165
See application file for complete search history.

(56) References Cited

U.S. PATENT DOCUMENTS

| | | | | |
|---|---|---|---|---|
| 4,068,445 | A | 1/1978 | Bobbitt | |
| 4,563,110 | A | 1/1986 | Langenbach, Jr. et al. | |
| 4,833,846 | A | 5/1989 | McFeetors et al. | |
| 4,838,737 | A * | 6/1989 | Quimby | 405/229 |
| 4,923,165 | A | 5/1990 | Cockman | |
| 4,974,997 | A | 12/1990 | Sero et al. | |
| 5,066,168 | A | 11/1991 | Holdeman | |
| 5,707,180 | A | 1/1998 | Vickars et al. | |
| 5,934,836 | A | 8/1999 | Rupiper et al. | |
| 6,128,867 | A | 10/2000 | MacKarvich | |
| 6,367,215 | B1 | 4/2002 | Laing | |
| 6,394,704 | B1 | 5/2002 | Saeki et al. | |
| 6,641,332 | B1 | 11/2003 | Alvarado | |
| 6,659,692 | B1 | 12/2003 | May | |
| 6,722,821 | B1 | 4/2004 | Perko et al. | |
| 6,820,379 | B1 | 11/2004 | Krinner et al. | |
| 6,872,031 | B2 | 3/2005 | May | |
| 6,881,014 | B2 | 4/2005 | Saeki et al. | |
| 7,004,683 | B1 * | 2/2006 | Rupiper | 405/229 |

* cited by examiner

*Primary Examiner*—Frederick L Lagman
(74) *Attorney, Agent, or Firm*—Donald L. Beeson; Beeson Skinner Beverly, LLP

(57) ABSTRACT

A lateral force resistance device for a ground achoring system suitably used in expansive soils has an inner sleeve structure and an outer collar connected to the inner sleeve structure by a plurality of load transfer members such as longitudinal load transfer plates. The lateral force resistance device is embedded in the soil over a ground anchor, such as a helical anchor, by sliding the inner sleeve structure of the device over the top end of the anchor and using an embedment method involving vibration, pushing or other technique. The outer collar of the lateral force resistance device provides a relatively large surface area displaced from the inner sleeve structure for providing efficient load transfer to the surrounding soil.

37 Claims, 5 Drawing Sheets

LATERAL FORCE RESISTANCE DEVICE

CROSS-REFERENCE TO RELATED APPLICATIONS

This application claims the benefit of U.S. Provisional Application Ser. No. 60/680,768 filed May 13, 2005.

BACKGROUND OF THE INVENTION

The present invention generally relates to ground anchoring systems for supporting building foundation structures, and more particularly to raised floor foundation systems with helical piles or small diameter pile foundation systems, commonly used at building sites having moderately to highly expansive soil conditions.

A number of factors, including the diminishing availability of residential lots having good soil conditions and topography, have forced builders of residential housing to consider building sites that are more challenging to build on, and that require special foundations and anchoring systems. This includes geographic regions in the United States having highly expansive clay soils, such as the desert areas of Arizona and Nevada. The fast-growing Las Vegas area is an example. There the buildable land is flat, but has moderate to highly expansive and corrosive soil conditions. As a result, most homes in the Las Vegas area have been built with ground floors and foundations in the form of pre-stressed, post-tensioned mat slabs. In such building systems, the foundation slab is approximately 10" to 18" thick, with thickened (deepened) edge beams. While mat slabs are cost-effective when building on soils that have little or no expansivity, the cost of using mat slabs in expansive soil conditions is substantial, due to the necessity of eliminating the uplifting forces on the slab caused by the expansivity of the soil. Typically, three or more feet of soil must be removed, reconditioned by moisture treating and then compacted in place. If the soil is highly expansive or corrosive, the soil may need to be removed altogether and replaced with an imported soil material. Environmental concerns associated with the additional earth work may further add to the cost.

Due to the cost associated with mat slab systems, homebuilders who build in highly expansive soil conditions, and particularly homebuilders in the Las Vegas area, frequently use raised floor foundation systems with helical anchors. However, such systems have a significant drawback, in that, they provide a relatively low degree of lateral support for the foundation system for resisting lateral forces such as produced by earthquakes or high winds. Therefore, a need exists for a way to increase the lateral resistance capacity of conventional anchoring systems used for raised foundations in expansive soils. A need also exists for a lateral force resistance device that can be used with standard anchoring systems, that is relatively economical to manufacture, and that is relatively easy to install.

SUMMARY OF THE INVENTION

The present invention is directed to a lateral force resistance device that can be used in connection with helical anchoring systems or other foundation support systems, such as steel pipes, to increase the resistance of the anchoring system to lateral forces exerted by the supported superstructure. The lateral force resistance device of the invention is relatively easily installed over existing ground anchors, and allows a lateral force resistive foundation to be constructed in expansive soils without the soil excavation associated with mat slab systems. The present invention also augments the vertical load carrying capacity of helical anchors and steel piles.

The lateral force resistance device of the invention is comprised of an inner sleeve structure sized to slide over the top of a ground anchor, such as a helical anchor or steel pipe, and a surrounding outer collar structure that provides a relatively large surface area for contacting the supporting soil. Load transfer members interconnect the inner sleeve structure and outer collar structure and act to transfer lateral loads produced by the superstructure supported on the ground anchor to the outer collar. The inner sleeve preferably has a top end that extends above the outer collar, and is preferably adapted for vibrating the lateral force retaining device into the soil using a vibrating machine. The extended end of the sleeve structure can also suitably be adapted for receiving a bearing cap for transferring vertical loads to the anchoring system exerted by the supporting building superstructure.

The method of invention is directed to method of installing a building ground anchor in a supporting soil with added lateral force resistance comprised of the steps of embedding a ground anchor in the soil, placing a lateral force resistance device in accordance with invention over the embedded anchor, and embedding the lateral force resistance device into the soil over the top of the anchor, suitably by vibrating it into the soil. In a further aspect of the method of the invention, a building foundation is constructed over the lateral force resistance device such that the anchoring system formed by the ground anchor and lateral force resistance device is tied to the foundation.

DETAILED DESCRIPTION OF THE ILLUSTRATED EMBODIMENTS

Lateral force restraining devices in accordance with the present invention, abbreviated herein as "LFRD's," are intended for use with helical anchors, steel support pipes, and the like (collectively referred to herein as "ground anchors") used to support above-grade building foundations such as commonly used in expansive soils. Where ground anchors are used, the addition of an LFRD will provide an efficient mechanism and method for efficiently transferring lateral forces, such as generated during earthquakes and high wind conditions, from the building's above-ground superstructure to the soil into which the ground anchors are embedded. The LFRD will also provide the ground anchors with additional vertical load capacity and additional resistance to the tendency of the anchor system to rotate due to unbalanced forces and reaction forces acting on the building superstructure at one end and on the anchor system at the other.

Figure 1:
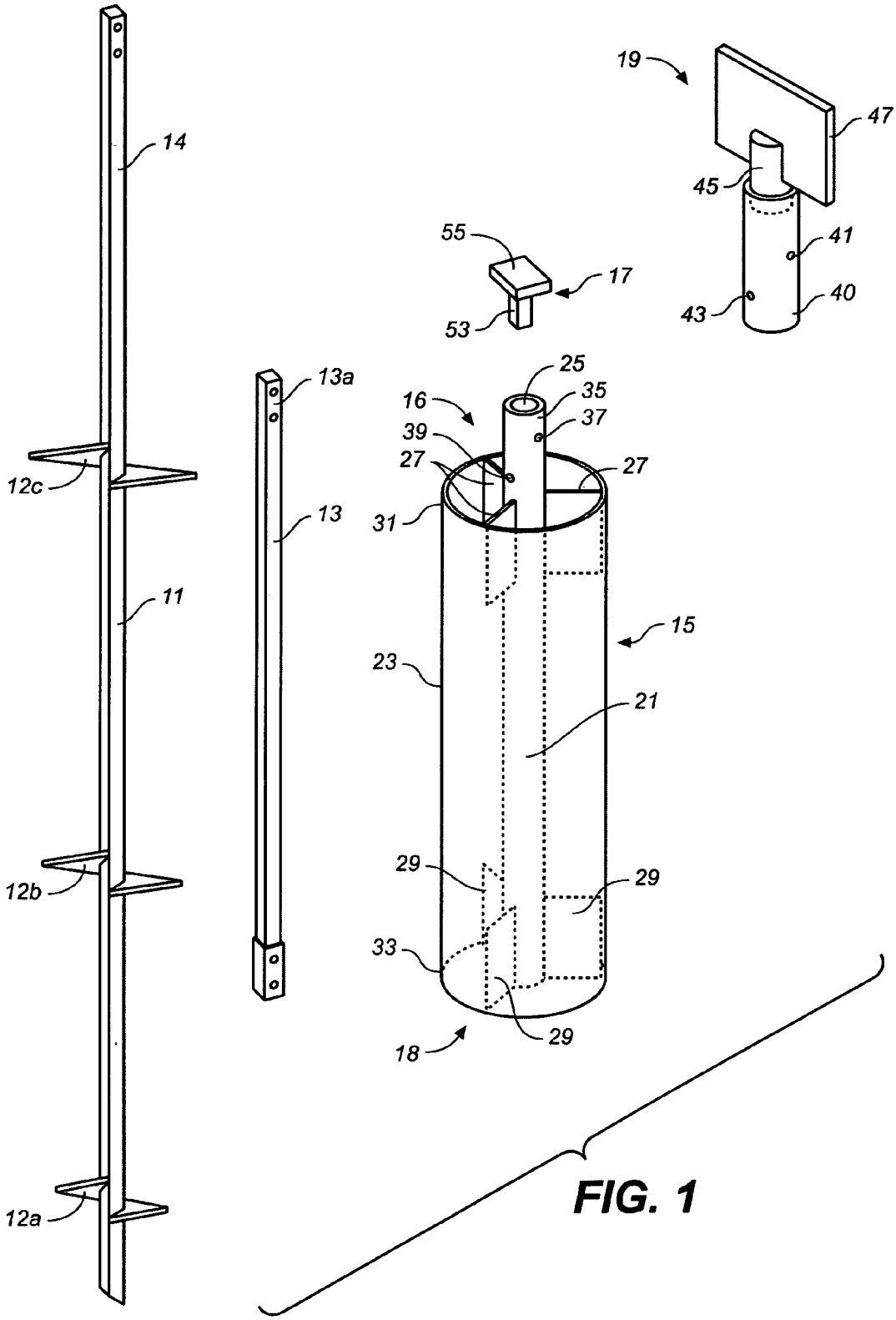
FIG. 1 is an exploded perspective view of a lateral force resistance device in accordance with the invention, together with a helical anchor and extension, a vibrator head for use in vibrating the helical anchor into the soil, and a bearing cap.
Figure 2A:
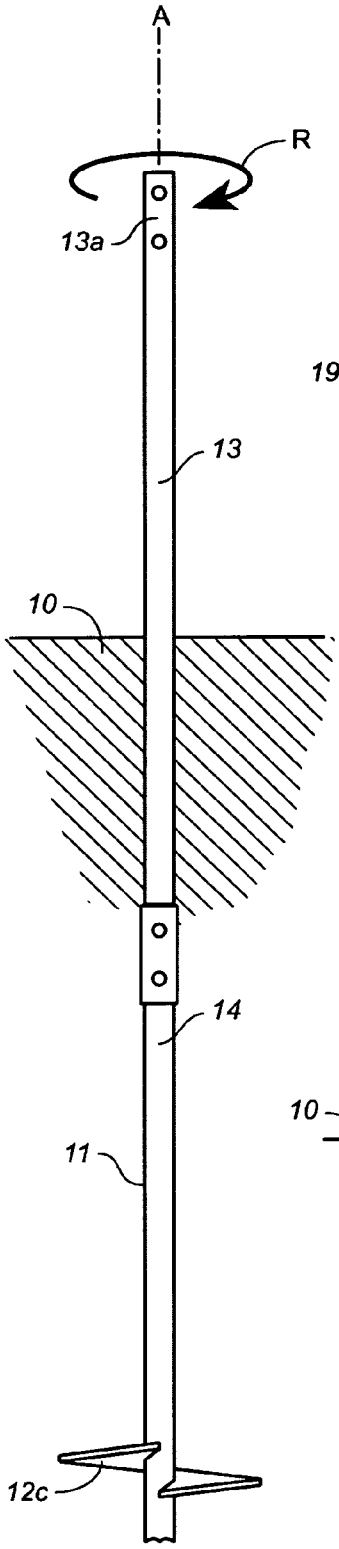
FIG. 2A is a graphic view in side elevation of the helical anchor shown in FIG. 1 being installed into the ground by rotation.
Figure 2B:
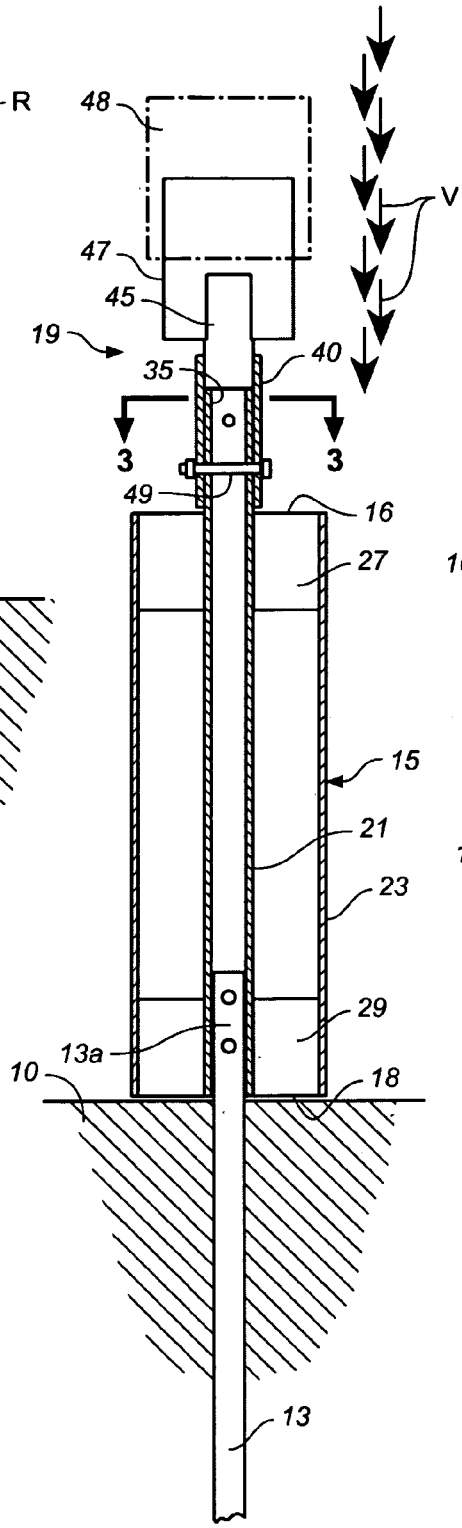
FIG. 2B is a graphical view of the helical anchor shown in FIG. 2A fully embedded in the supporting soil, and the lateral force resistance device shown in FIG. 1 placed over the top of the helical anchor prior to vibrating the lateral force resistance device into the supporting soil.
Figure 2C:
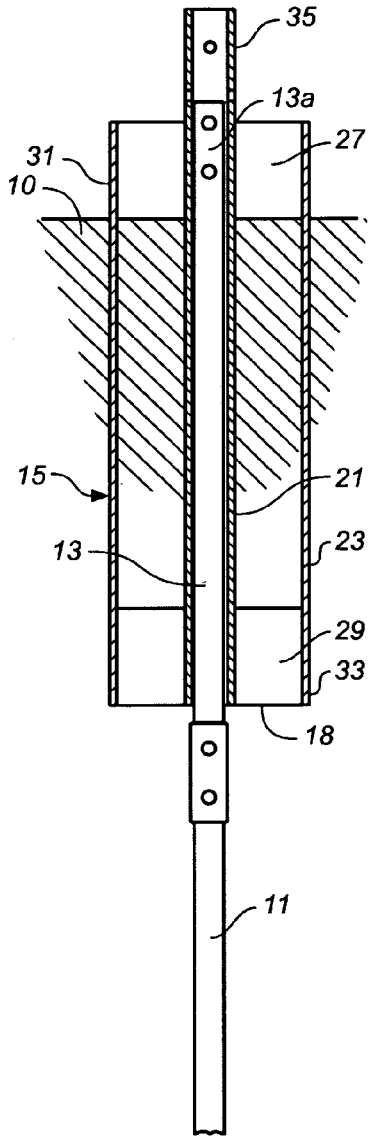
FIG. 2C is a graphic representation of the helical anchor and lateral force resistance device after the lateral force resistance device has been vibrated into the supporting soil.
Figure 2D:
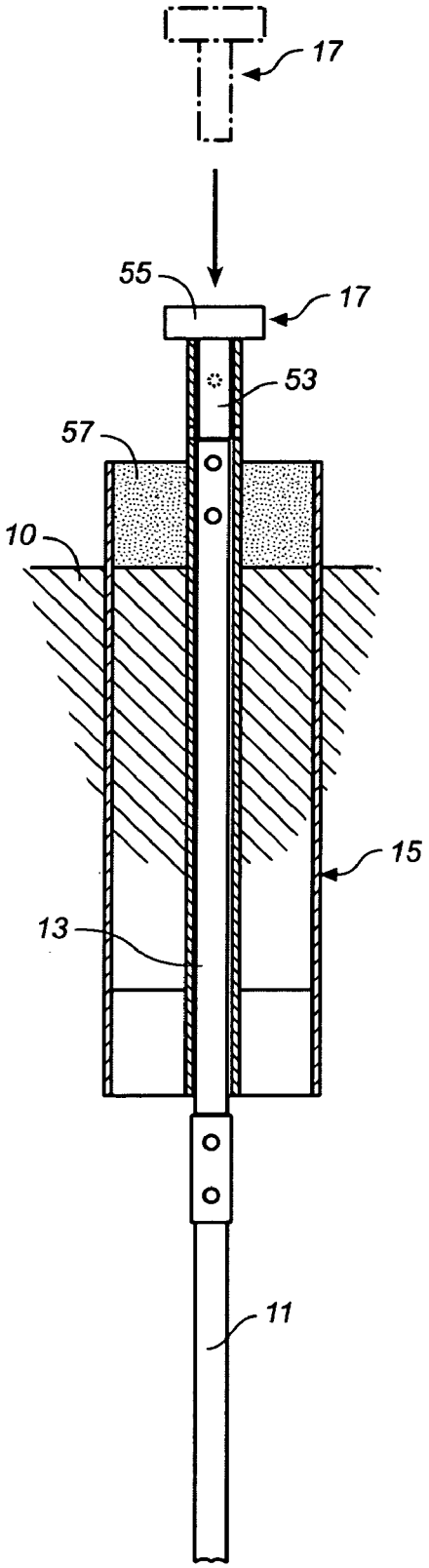
FIG. 2D is a graphic representation of the embedded helical anchor and lateral force resistance device as shown in FIG. 2C with a bearing cap inserted into the top of the lateral force resistance device.
Figure 2E:
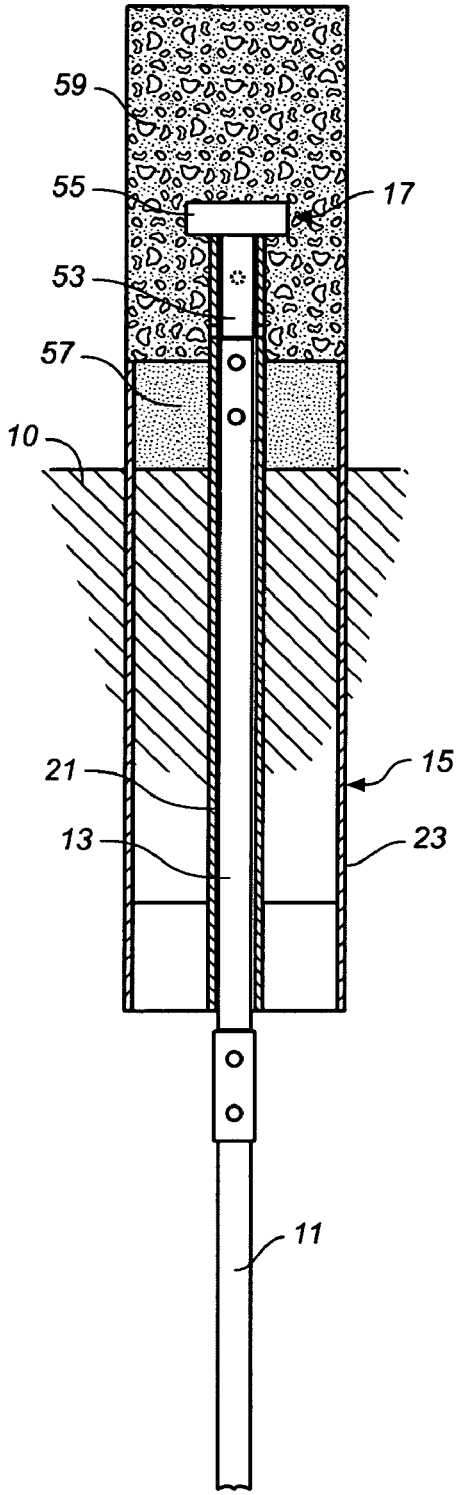
FIG. 2E is a graphic representation of the embedded helical anchor, lateral force resistance device, and bearing cap after a concrete grade beam has been poured in place over the top of the lateral force resistance device and bearing cap.
Figure 2F:
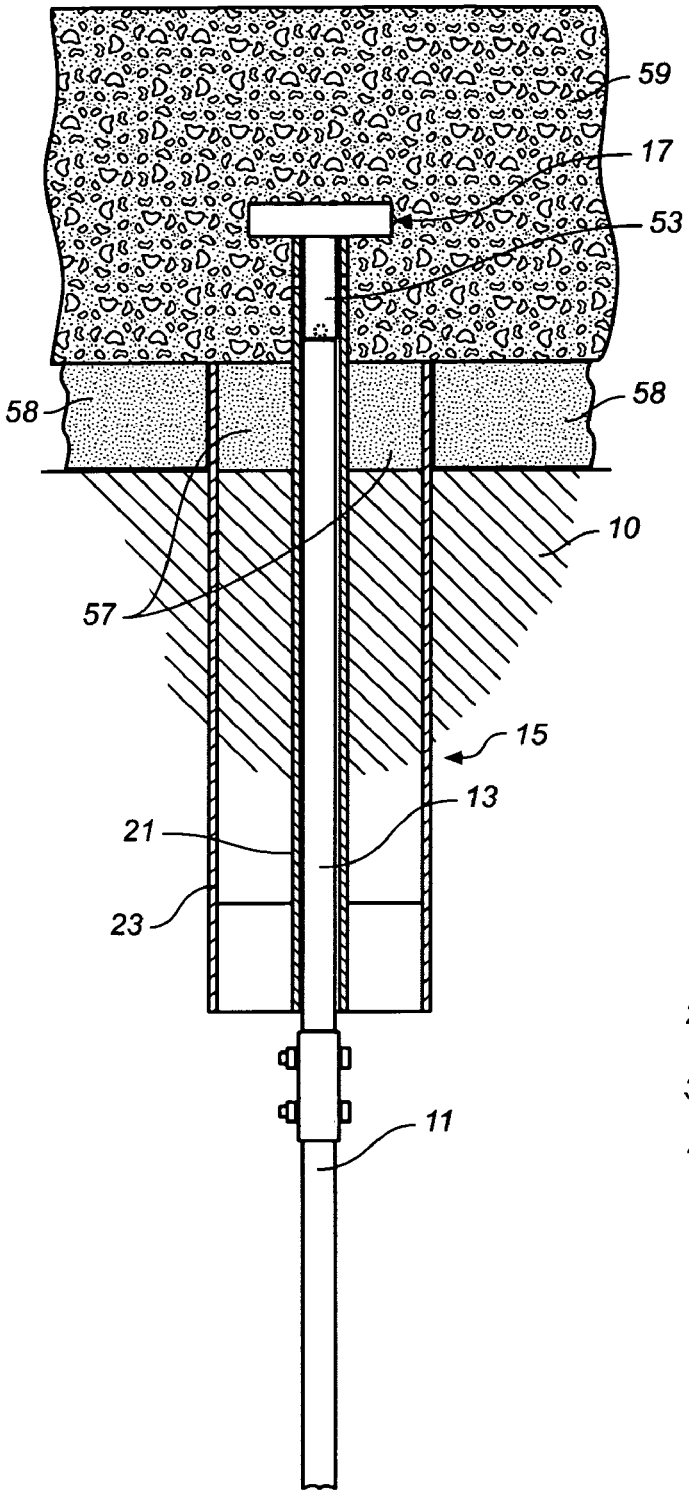
FIG. 2F is a graphic representation of the embedded helical anchor and lateral force resistance device and grade beam shown in FIG. 2E rotated by 90 degrees.
Figure 3:
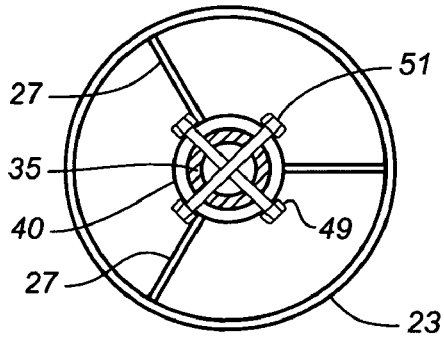
FIG. 3 is a top plan view in partial cross-section of the lateral force restraining device and vibrator head taken along lines 4-4 in FIG. 2B.

Referring now to the drawings, FIGS. 1-3 show components of an LFRD ground anchoring system and for installing the LFRD of the anchoring system. Shown are a conventional helical anchor 11 and anchor extension 13, the LFRD 15, a load-bearing cap 17 exploded from the top of the LFRD, and a vibrator head 19 used to vibrate the LFRD into the soil as hereinafter described. (It shall be understood that, unless otherwise specified, any reference herein to a helical anchor or other ground anchor is meant to include any anchor extensions used therewith.) The illustrated LFRD 15 is comprised of an inner or central sleeve structure 21 surrounded by an outer collar structure 23 having a significantly larger cross-sectional dimension than the inner sleeve so as to provide a relatively large, radially displaced surface area over a substantial portion of the length of the LFRD. Both inner sleeve 21 and outer collar 23 are preferably cylindrical in shape, however, it is understood that the invention is not limited to an LFRD having a cylindrical geometry. The cross-sectional shape of the inner sleeve, for example, could be square, provided its central bore 25 is suitably dimensioned to slide over the ends of the ground anchors with which the LFRD is to be used. In the illustrated embodiment, the inside diameter of cylindrical sleeve bore 25 is sized to slide over the square helical anchor extension 13 shown in FIG. 1. This requires an inside diameter larger than the diagonal dimension of the extension. The dimensions of the sleeve bore should provide for a relatively snug fit between the anchor and the LFRD.

The LFRD 15 additionally includes a plurality of radially extending load transfer members that interconnect the inner sleeve 21 and the outer collar 23, and that transfer loads exerted on the inner sleeve to the outer collar. The loads transferred to the outer collar will include both lateral loads produced by lateral forces on the supported building superstructure and vertical loads produced by the weight of the building. The load transfer members should have a relatively thin transverse profile, that is, a profile having a thin dimension in the plane perpendicular to the insertion axis of the LFRD, which is denoted in FIG. 2A by the letter "A." The load transfer members' thin transverse profile will minimize the resistive forces exerted on the LFRD when it is inserted into an expansive soil.

In the illustrated embodiment, the load transfer members are provided in the form of two sets of longitudinal load transfer plates 27, 29. The load transfer plates are located, respectively, at the top end 31 and bottom end 33 of the outer collar, and provide a strong load transfer structure with a desired thin profile. The sets of longitudinal plates 27, 29 are preferably rotationally aligned to reduce resistance to insertion of the LFRD into the soil. The number, size, and thickness of the load transfer plates may vary according to structural requirements for specific applications and according to the component materials used. And while the preferred embodiment of the invention contemplates the use of two sets of top and bottom load transfer members in the form of plates, it is not intended that the invention be limited to the use of plates or to the use of separate sets of load transfer members. For example, it is within the scope of the invention to provide the LFRD with a single set of longitudinal load transfer plates extending substantially the length of the LFRD outer collar, or to provide multiple sets of short longitudinal plates or spokes distributed along the length of the outer collar. Generally, it is desirable that the load transfer members be evenly distributed about the inner sleeve, however, this is not required.

With further reference to FIG. 1, it can be seen that the inner sleeve of the illustrated LFRD has a top end 35 that extends above the top end 31 of the outer collar of the LFRD. This extended top end of the sleeve allows for means of attaching a vibrator head 19 to the top of the LFRD for vibrating the LFRD in place as hereinafter described. It is also available to receive bearing cap 17, which can be used to transfer loads to the LFRD when the extended top end of the inner sleeve is anchored in concrete, such as in a poured concrete grade beam, as also hereinafter described. Right angle bolt holes 37, 39 are provided in the inner sleeve's top end 35 to allow for the attachment of the vibrator head 19, which has corresponding bolt holes 41, 43.

The use and method of installing the LFRD 15 with a helical anchor are illustrated in FIGS. 2A-2F. Referring to FIG. 2A, the helical anchor 11 having progressive helices 12*a*, 12*b*, 12*c*, is provided with an extension 13, which can be attached to the end of the anchor's shaft 14 to extend the depth to which the helical anchor is embedded in the soil. The helical anchor is first embedded in the typically expansive soil 10 by available drilling machinery (not shown), which rotates the helical anchor under pressure into the soil as denoted by the rotation arrow R. The helical anchor is rotated into the ground until the top end 16 of the anchor extension 13 projects a desired distance above ground level as illustrated in FIG. 2B.

Once the helical anchor has been installed as shown in FIG. 2B, the bottom 18 of the LFRD is placed over the top end 13*a* of the helical anchor extension projecting above supporting soil 10 so that anchor extension's top end slides into the LFRD's inner sleeve 21. Vibrator head 19, which is comprised of support collar 40, center plug 45, and grab plate 47, is then attached to the LFRD by sliding the vibrator head's support collar over the top end 35 of the LFRD's inner sleeve 21 until the center plug 45 contacts the inner sleeve. In this position, and after rotating the vibrator head on the inner sleeve as necessary to align the vibrator head's bolt holes 41, 43 with the bolt holes 37, 39 in the top end of the inner sleeve, the vibrator head is bolted to the inner sleeve by bolts 49, 51 as best shown in FIG. 3. With the vibrator head in place, a vibrating machine (not shown), which grabs onto grab plate 47 as graphically illustrated in FIG. 2B by broken lines 48, is used to vibrate the LFRD into the supporting soil 10 by a vibrating motion, which is graphically represented by the vibration arrows "V."

It is here noted that it may be possible to embed the LFRD in the ground over the ground anchor using methods other than described above, including pushing instead of vibrating the LFRD into the soil. Pushing may, for example, be a suitable method of embedment in softer soil conditions. Suitable machinery could be used for pushing on the end of the LFRD having a suitable pushing head, such as a head similar to the vibrator head 19, but with a modified top. Depending on soil conditions, the LFRD might also be embedded by drawing it into the ground behind the ground anchor, such as by a plate attached to the anchor shaft ahead of the LFRD, which rotates freely relative to the LFRD as the anchor is installed. This embedment method could be used in combination with vibration.

FIG. 2C shows the LFRD after it has been vibrated (or otherwise embedded) into the supporting soil 10 over the helical anchor extension 13. In this illustrated embodiment, the LFRD can be vibrated down into the soil until the bottom-most retaining bolt 49 of the vibrator head 19 reaches the top end 13*a* of the helical anchor extension 13. It is seen that, in the position of the LFRD shown in FIG. 2C, the top end 35 of the inner sleeve 21 of the LFRD extends above the top end 13*a* of the helical anchor extension 13. This will allow for the insertion of a bearing cap, such as the bearing cap 17 shown in FIG. 1, into the sleeve. In the position shown in FIG. 2C, it can also be seen that the top end 31 of the LFRD's outer collar 23, together with the upper set of load transfer plates 27, are also above grade. In the illustrated application, this is the desired extent of the insertion of the LFRD into the supporting soil; however, it is understood that in other applications the LFRD may be inserted further into the soil than shown, including possible insertion into the soil until the top of the LFRD outer collar 23 is even with or below grade. In still other applications, the finished grade may lower on one side of the LFRD than the grade on the other side of the LFRD. The method of using the LFRD is not intended to be limited to the application and embedment of the LFRD relative to the grade shown and described.

Referring to FIG. 2D, it can be seen that the load-bearing cap 17, which is comprised of insertion post 53 and a horizontal top plate 55, is inserted into the top of the LFRD inner sleeve 21 prior to the pouring of the foundation for the supported superstructure. Load-bearing cap 17 acts to provide a greater surface area over which vertical forces can be transferred to the helical anchor and the LFRD installed on the anchor. The insertion post 53 of the bearing cap suitably has a cross-sectional dimension corresponding to the cross-sectional dimension of the helical anchor extension 13, but could have other cross-sectional shapes. It also preferably has a length that allows the insertion post to contact the top of the helical anchor extension when fully inserted into the top of the LFRD, such that vertical loads are transferred directly to the anchor. In the illustrated embodiment, the bearing cap is seen to simply set into the LFRD sleeve without a separate attachment, however, it is contemplated that means for attaching the bearing cap to the LFRD sleeve could be provided, and would be desirable where soil is likely to produce large uplifting forces that may be transferred to the foundation.

Prior to pouring the concrete foundation over the LFRD, the above-grade volumes formed at the top end 16 of the LFRD inside the outer collar 23 and between the load-transfer plates 27 are preferably filled with a compressible void-form material such as cardboard or Styrofoam. The void-form material will absorb the uplifting forces of the supporting soil 10 in expansive soil conditions, preventing moderate uplifting forces from being transferred to the building foundation.

FIGS. 2E and 2F show a concrete grade beam 59 of a building foundation after it has been poured over the top of the LFRD 15 and bearing cap 17. The illustrated concrete grade beam would be poured in a manner well known in the art using concrete forms (not shown) which are removed after the pour and after the concrete has set. As shown in FIG. 2F, additional compressible void-form material 58 can be used in the concrete forms to similarly keep the grade beam elevated above the soil 10, and to keep uplifting vertical loads from the soil from being transferred to the grade beam.

The LFRD can suitably be made from steel components, with steel load-transfer plates 27, 29 being welded to the steel inner sleeve 21 along one edge and to the inside of the steel outer collar 23 at the opposite edge. However, it shall be understood that the LFRD of the invention could be fabricated of other materials, such as PVC plastic, and is not limited to any particular component materials or fabrication method. Also, the LFRD component dimensions may vary depending on the application, so long as a sufficient load-bearing surface area is provided by the outside surfaces of the LFRD's outer collar. The following is an example of suitable specifications for the LFRD illustrated in FIGS. 1-3, where the LFRD is fabricated of steel:

For the inner pipe 21: a 2½" diameter schedule 40 PST pipe having a length of approximately 43".

For the outer collar 23: an ASTM A513 Type 1 steel cylinder having a 12" outside diameter, a 3/16" wall thickness, and a length of approximately 36".

For the load-transfer plates 27, 29: ¼ inch×6 inch HRFB steel plate having a longitudinal dimension of approximately 6 inches and a transverse dimension of 4⅜ inches.

Corrosion protection can suitably be provided by galvanizing the steel components, by providing an epoxy coating, or by other means.

For an LFRD having the above specifications, the top end 35 of the inner sleeve 21 would project approximately 7" above the top of the outer collar 23. In order to provide a sufficient load-bearing surface area, it is contemplated that the outer collar 23 will have an outside diameter of between about ten inches and two feet, and a length of between about three and four feet, however, it is not intended that the invention be limited to these outer collar size ranges, provided there is a sufficient load-bearing surface area for the particular application. The upper range for the size of the outer collar will be limited by practical considerations, such as the ability to manipulate the LFRD on site and the ease of vibrating the LFRD into the ground.

Figure 4:
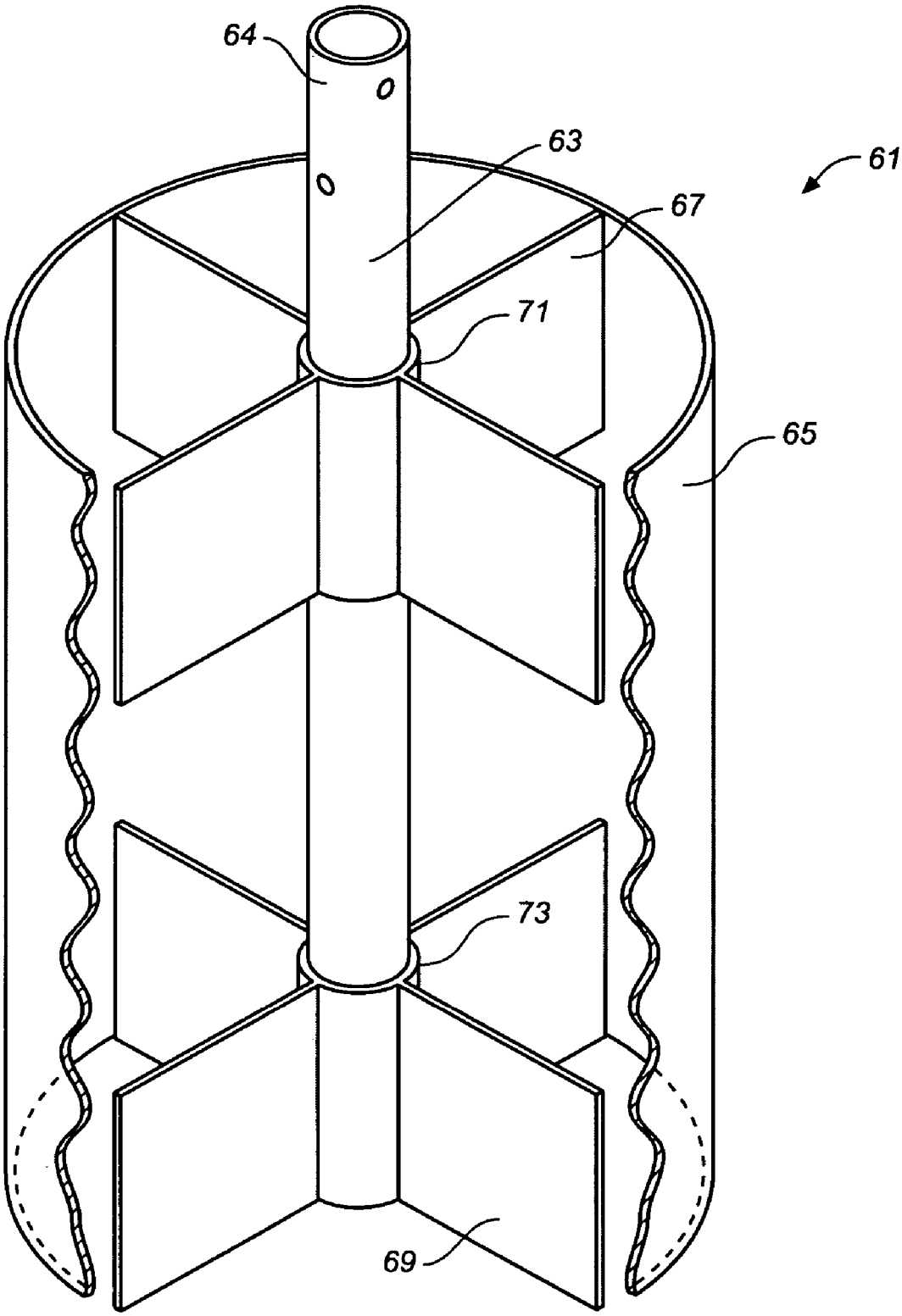
FIG. 4 is a broken-away top perspective view of another embodiment of a lateral force restraining device in accordance with the invention.

FIG. 4 illustrates an alternative construction for the LFRD of the invention, and a construction wherein the LFRD diameter is somewhat larger in relation to its length. In FIG. 4, LFRD 61 is comprised of inner sleeve 63, outer collar 65, and two sets of load transfer plate structures 67, 69 positioned at the top and the bottom of the outer collar. Each of the load transfer plate structures 67, 69 are comprised of four longitudinal plates 67, 69 evenly distributed about a separate plate support collar 71, 73 sized to fit over the LFRD's inner sleeve 63. The load-transfer plates 67, 69 extend between their respective plate support collars 71, 73 and to the LFRD's outer collar 65. If steel components are used, attachment of the plates to the collars can be made by welding. Also, the outer collar, load-transferring plates and plate support collars can be fabricated as a sub-assembly into which inner sleeve 63 can be inserted and welded in place. As with the previously described embodiment, the top end 64 of the inner sleeve 63 of the LFRD shown in FIG. 4 projects above the top of the outer collar 65 to provide a means for attaching vibrating machinery to the LFRD, and receiving a bearing cap such as bearing cap 17.

It is noted that the invention is not limited to an LFRD having a continuous inner sleeve such as the inner sleeves 21 and 63 shown in the illustrated embodiments. For example, the inner sleeve structure of the LFRD for slidably engaging the ground anchor could be provided by plate support collars such as shown in the embodiment of the LFRD shown in FIG. 4, with the length of plate support collars being optionally extended as required to provide adequate support and load transference. The top-most plate support collar 71 in FIG. 4 could also be provided with an upward extension to provide a projecting top end, such as the projecting top end 64 in the FIG. 4 embodiment.

It is still further noted that, in the illustrated embodiment of the invention, the inner sleeve structure (sleeve 21 in FIGS. 1-3), is not shown as being mechanically connected to the ground anchor. However, it will be appreciated that in some applications this may be desirable, for example, where large uplift forces will be experienced. Such a mechanical connection can be made by any means, such as by providing suitable holes in the LFRD sleeve, which align with corresponding holes in the anchor and which receive connecting pins, bolts, threaded rods, or the like. Concrete reinforcing rods could also be used to connect the sleeve and anchor while tying the anchor and sleeve to a beam support for the superstructure.

While the present invention has been described in considerable detail in the foregoing specification and the accompanying drawings, it is not intended that the invention be limited to such detail, except as necessitated by the following claims.

What we claim is:

1. A lateral force resistance device for use with elongated building ground anchors embedded in a supporting soil along an insertion axis, said lateral force resistance device comprising an elongated inner sleeve structure for slidably engaging a building ground anchor in a supporting soil, an elongated outer collar structure surrounding said inner sleeve structure for providing a relatively large surface area radially displaced from said inner sleeve structure, and a plurality of load transfer members interconnecting said inner sleeve structure and said outer collar structure and acting to transfer lateral loads from the inner sleeve structure to the outer collar structure, said load transfer members extending longitudinally in the direction of the insertion axis for providing load transfer over a length of said inner sleeve structure and said outer collar structure, said load transfer members having a thin profile in a plane perpendicular to the insertion axis of the ground anchor.

2. The lateral force resistance device of claim 1 wherein said outer collar structure is a cylindrical collar surrounding said inner sleeve structure.

3. The lateral force resistance device of claim 1 wherein said outer collar structure has a top and a bottom and wherein said inner sleeve structure has a top extended end which extends above the top of said outer collar structure.

4. The lateral force resistance device of claim 3 wherein the top extended end of said inner sleeve structure has an attachment structure for attaching vibrating machinery thereto for vibrating the lateral force resistance device into to the soil.

5. The lateral force resistance device of claim 4 wherein said attachment structure includes at least one bolt hole in the top extended end of said inner sleeve structure.

6. The lateral force resistance device of claim 1 wherein said load transfer members are in the form of longitudinal load transfer plates extending radially from said inner sleeve structure.

7. The lateral force resistance device of claim 6 wherein there are at least three longitudinal load transfer plates.

8. The lateral force resistance device of claim 1 wherein said outer collar structure has a top and a bottom and wherein at least two sets of load transfer members are provided, one of said sets of load transfer members being located at the top of said outer collar structure, and the other of said sets of load transfer plates being located at the bottom of said outer collar structure.

9. The lateral force resistance device of claim 8 wherein each of said sets of load transfer members is comprised of at least three plates distributed around said inner sleeve structure.

10. The lateral force resistance device of claim 1 wherein said plurality of load transfer members are uniformly distributed around said inner sleeve structure.

11. The lateral force resistance device of claim 1 wherein said outer cylindrical collar has a diameter of between about ten inches and two feet.

12. The lateral force resistance device of claim 1 wherein said outer collar structure has a length of between about three and four feet.

13. The lateral force resistance device of claim 1 wherein said outer collar structure has a length of about at least three feet, and an outside diameter of at least about ten inches.

14. A lateral force resistance device for use with elongated building anchors embedded in a supporting soil along an insertion axis, said resistance device comprising an inner sleeve structure for slidably engaging a building anchor in a supporting soil, an outer cylindrical collar surrounding said inner sleeve structure, said outer collar having a top and a bottom and providing a relatively large surface area radially displaced from said inner sleeve structure, and at least two sets of longitudinal load transfer plates interconnecting said inner sleeve structure and said outer collar and acting to transfer lateral loads from the inner sleeve structure to the outer collar over a length of said inner sleeve structure and said outer collar, one of said sets of longitudinal plates being located at the top of said outer collar, and the other of said sets of longitudinal plates being located at the bottom of said outer collar.

15. The lateral force resistance device of claim 14 wherein each of said sets of load transfer plates is comprised of at least three longitudinal plates distributed around said inner sleeve structure.

16. The lateral force resistance device of claim 14 wherein said load transfer plates are uniformly distributed around said inner sleeve structure.

17. The lateral force resistance device of claim 14 wherein said outer cylindrical collar has a diameter of between about ten inches and two feet.

18. The lateral force resistance device of claim 17 wherein said outer collar structure has a length of between about three and four feet.

19. The lateral force resistance device of claim 18 wherein said inner sleeve structure has a top extended end which extends above the top of said outer collar.

20. The lateral force resistance device of claim 19 wherein the top extended end of said central sleeve structure has an attachment structure for attaching vibrating machinery thereto for vibrating the lateral force resistance device into to soil.

21. A lateral force resistance device for use with elongated building anchors imbedded in a supporting soil along an insertion axis, said resistance device comprising an elongated inner sleeve for slidably engaging a building anchor in a supporting soil, and an outer cylindrical collar surrounding said inner sleeve, said outer collar having an open top end and an open bottom end, said inner sleeve extending beyond the open top end of said outer cylindrical collar, said elongated inner sleeve and said outer collar being interconnected over a longitudinal portion of the length thereof such that lateral forces exerted on said inner sleeve are transferred to said outer collar over such longitudinal portion, and such that the interconnection between said inner sleeve and outer collar permits insertion of the lateral force resistance device into the supporting soil.

22. The lateral force resistance device of claim 21 wherein said outer collar has a length of about at least three feet, and an outside diameter of at least about ten inches.

23. The lateral force resistance device of claim 21 wherein said inner sleeve extends above the top of said outer collar, and has an attachment structure for attaching vibrating machinery thereto for vibrating the lateral force resistance device into to the soil.

24. A lateral force resistance device for use with elongated building anchors imbedded in a supporting soil, said resistance device comprising anchor engagement means for slidably engaging a building anchor in a supporting soil, outer collar means surrounding said building anchor engaging means for providing a relatively large surface area radially displaced from said building anchor engaging means, and longitudinally extending means for transferring lateral loads from said anchor engagement means to said outer collar means over a length of said anchor engagement means and said outer collar means.

25. The lateral force resistance device of claim 24 further comprising means for attaching vibrating machinery to the lateral force resistance device for vibrating said device under pressure into the supporting soil.

26. A method of installing an elongated building ground anchor in a supporting soil with added lateral force resistance, comprising providing a lateral force resistance device comprised of an inner sleeve structure, and outer collar structure surrounding said inner sleeve structure for providing a relatively large surface area radially displaced from said inner sleeve structure, and a plurality of load transfer members having a relatively small transverse profile in relation to the insertion axis, said load transfer members interconnecting said inner sleeve structure and said outer collar structure and extending longitudinally in the direction of said insertion axis for providing load transfer over a length of said inner sleeve structure and said outer collar structure, embedding the elongated building ground anchor in the supporting soil such that the top of the anchor projects from the soil, placing the lateral force resistance device over the top of the ground anchor such that the top of the ground anchor is engaged in the inner sleeve structure of the lateral force resistance device, and embedding the lateral force resistance device into the supporting soil over the ground anchor to a desired depth.

27. The method of claim 26 wherein the step of embedding the lateral force resistance device into the supporting soil over the ground anchor to a desired depth comprises attaching a vibrating machine to the top of the lateral force resistance device, and vibrating the lateral force resistance device into the supporting soil over the ground anchor to a desired depth.

28. The method of claim 27 wherein a vibrator head is used to attach a vibrating machine to the top of the lateral force resistance device.

29. The method of claim 27 wherein the lateral force resistance device is vibrated into the supporting soil over the ground anchor to a depth wherein an open top portion of the outer collar of the lateral force resistance device remains above the soil.

30. The method of claim 26 further comprising filling the open top portion of the outer collar of the lateral force resistance device with a compressible material, and pouring a concrete foundation over the top of the ground anchor and lateral force resistance device.

31. The method of claim 26 further comprising constructing a building foundation over the lateral force resistance device such that the anchoring system formed by the ground anchor and lateral force resistance device is tied to the foundation.

32. The method of claim 31 further comprising adding a load-bearing cap to the top of the inner sleeve structure of the lateral force resistance device after the lateral force resistance device has been embedded in the soil.

33. The method of claim 26 wherein said outer collar structure of said lateral force resistance device has a top and a bottom and wherein at least two sets of load transfer members are provided, one of said sets of load transfer members being located at the top of said outer collar structure, and the other of said sets of load transfer plates being located at the bottom of said outer collar structure.

34. The method of claim 33 wherein said load transfer members are in the form of longitudinal load transfer plates extending radially from said inner sleeve structure.

35. A lateral force resistance device for use with elongated building ground anchors embedded in a supporting soil along an insertion axis, said lateral force resistance device comprising an elongated inner sleeve structure for slidably engaging a building ground anchor in a supporting soil, said inner sleeve structure having a top extended end, an elongated outer collar structure surrounding said inner sleeve structure for providing a relatively large surface area radially displaced from said inner sleeve structure, said outer collar structure having a top and a bottom, the top extended end of said inner sleeve structure extending above the top of said outer collar structure, and a plurality of load transfer members interconnecting said inner sleeve structure and said outer collar structure and acting to transfer lateral loads from the inner sleeve structure to the outer collar structure, said load transfer members having a relatively small transverse profile in a plane perpendicular to the insertion axis of the ground anchor.

36. The lateral force resistance device of claim 35 wherein the top extended end of said inner sleeve structure has an attachment structure for attaching vibrating machinery thereto for vibrating the lateral force resistance device into to the soil.

37. A lateral force resistance device for use with elongated building anchors imbedded in a supporting soil along an insertion axis, said resistance device comprising an elongated inner sleeve for slidably engaging a building anchor in a supporting soil, and an outer cylindrical collar surrounding said inner sleeve, said outer collar having an open top end and an open bottom end, said inner sleeve extending beyond the open top end of said outer cylindrical collar, said elongated inner sleeve and said outer collar being interconnected such that lateral forces exerted on said inner sleeve are transferred to said outer collar, and such that the interconnection between said inner sleeve and outer collar permits insertion of the lateral force resistance device into the supporting soil, and said inner sleeve extending above the top of said outer collar and having an attachment structure for attaching vibrating machinery thereto for vibrating the lateral force resistance device into to the soil.

* * * * *

UNITED STATES PATENT AND TRADEMARK OFFICE

CERTIFICATE OF CORRECTION

PATENT NO. : 7,416,367 B2
APPLICATION NO. : 11/417674
DATED : August 26, 2008
INVENTOR(S) : Gene St. Onge, Dan Rhoades and James Winslow It is certified that error appears in the above-identified patent and that said Letters Patent is hereby corrected as shown below:

Title Page item 57 Abstract, line 1, “achoring” should read --anchoring--.
Col. 2, line 19, “a” should be inserted between “directed to” and “method”.
Col. 2, line 20, “in a supporting” should read --in supporting--.
Col. 4, line 46, “the” should be inserted between “that” and “anchor”.
Col. 5, line 28, “be” should be inserted between “may” and “lower”.
Col. 8, line 59, “device into to” should read --device into the--.
Col. 10, line 57, “device into to” should read --device into the--.
Col. 12, line 4, “device into to” should read --device into the--.

Signed and Sealed this

Twenty-eighth Day of October, 2008

JON W. DUDAS
*Director of the United States Patent and Trademark Office*